US006858177B2

(12) United States Patent
Kono et al.

(10) Patent No.: US 6,858,177 B2
(45) Date of Patent: Feb. 22, 2005

(54) METHOD FOR FABRICATING METAL MATRIX COMPOSITE

(75) Inventors: Akira Kono, Nagoya (JP); Takeshi Yamada, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 231 days.

(21) Appl. No.: 10/281,355

(22) Filed: Oct. 28, 2002

(65) Prior Publication Data

US 2003/0082311 A1 May 1, 2003

(30) Foreign Application Priority Data

Oct. 29, 2001 (JP) ..... 2001-330781

(51) Int. Cl.[7] ..... B22F 7/00
(52) U.S. Cl. ..... 419/5; 419/8; 419/9; 419/49
(58) Field of Search ..... 419/5, 8, 9, 49

(56) References Cited

U.S. PATENT DOCUMENTS 5,096,518 A * 3/1992 Fujikawa et al. ..... 158/89.28
5,579,532 A * 11/1996 Edd ..... 419/2
5,897,922 A * 4/1999 Saxena et al. ..... 427/455
6,122,884 A * 9/2000 Talwar ..... 52/729.2

FOREIGN PATENT DOCUMENTS

| | | |
|---|---|---|
| JP | 7-032332 | 2/1995 |
| JP | 7-080625 | 3/1995 |

* cited by examiner

*Primary Examiner*—Ngoclan T. Mai
(74) *Attorney, Agent, or Firm*—Oblon, Spivak, McClelland, Maier & Neustadt, P.C.

(57) ABSTRACT

The present invention provides a method for fabricating a metal matrix composite having high specific strength and stable performance and capable of fabricating at low cost, the method comprising heating a preform of metal matrix with reinforcing fiber to the temperature, which is below the high temperature region, of low temperature region or medium temperature region of the plastic deformation temperature of the metal matrix in a pressure vessel having an initial processing pressure and keeping for a predetermined time for a preparative treatment before the step of hot-isostatic-pressing the preform by keeping at a high temperature region capable of HIP treatment and of diffusing welding temperature of the metal matrix in a pressure vessel; for instance, in case metal matrix is titan or titan alloy, the preparative treatment is conducted at a preparative treatment temperature of about 300° C. to 700° C. and at a pressure in the pressure vessel of about 30 to 100 kg/cm$^2$.

6 Claims, 7 Drawing Sheets

11

12
11

13

13

20

20

METHOD FOR FABRICATING METAL MATRIX COMPOSITE

BACKGROUND OF THE INVENTION

1. Field of the Invention

The present invention relates to a method for fabricating a composite having a high specific strength and a high specific rigidity, applicable to component parts such as those of an aircraft engine and particularly to a method for fabricating a composite of metal matrix such as titan or titan alloy having reinforcing fibers such as silicon carbide fibers.

2. Description of the Related Art

Heretofore, composites formed by combining plural materials have been used widely. Metal matrix composites such as titan matrix composite (TMC) have been intensively studied and developed for component parts, such as those of aircraft engines, requiring high specific strength and high specific rigidity. The composites are reinforced in such a way that reinforcing materials typified by ceramic fibers such as silicon carbide or alumina fiber are mixed with metal matrices consisting of metals or metal alloys.

In fabricating such component parts where the metal matrix composite used, a circular disc or an annulus members such as a disc or a ring of a fan rotor is fabricated in such a manner that mono-tape preform consisting of titan alloy mixed with reinforcing fibers is composed by hot isostatic pressing (herein after referred as HIP), reinforcing fibers which have contained metal matrix by wrapping reinforcing fibers around a titan alloy drum are treated by HIP, or spiral formed reinforcing fibers which are lapped alternately between titan alloy foils are treated by HIP.

A fabricating method of composite material using mono-tape that is low in cost and capable of least dimension change when composing is as follows.

As shown in FIG. 7, a mono-tape preform 19 is made by aligning SiC reinforcing fibers 12, sandwiching the aligned fibers between metal (alloy) matrix foil 15 and hot-pressing the sandwiched materials with a hot press 17 while winding around a take-up roller 18. The mono-tape preform is convolved at a low temperature as shown in FIG. 8(*a*), then hot-isostatic pressed to form a ring form titan matrix composite 23 shown in FIG. 8(*b*).

Hot isostatic pressing is inevitable for a fabricating process of metal matrix composite as described above. In a hot isostatic pressing method, material is pressed isotropically in a metal vessel while heating. The method is utilized for adhesion of different materials, consolidation of powder material, compacting a sintered body, eliminating defects in a sintered body and others. It is necessary to improve the performance of material using such treatment of material particularly such as titan which is used under severe condition for problems arise in connection to such characteristics as fatigue or impact strength.

The hot isostatic pressing is usually carried out under the temperature and pressure condition shown in FIG. 9 with composite material in which reinforcing fibers are mixed with metal matrix. In FIG. 9, Bp denotes a pressure condition in conventional hot isostaitc pressing and Bt a temperature condition.

First, the mono-tape preform 19 is put in a HIP vessel where an initial pressure and temperature is set. In case Ti-4.5Al-3V-2Fe-2Mo alloy is used, for example, the initial pressure is set at about 30 kg/cm$^2$ and the temperature at about 400 degrees Celsius. After that, the temperature is gradually raised to a high temperature region of HIP treatment that is a temperature of plastic deformation and diffusion and is kept there for a predetermined time. An appropriate temperature of HIP treatment of Ti-4.5Al-3V-2Fe-2Mo alloy is, for example, is about 775 degrees Celsius.

And, after the temperature is raised to a predetermined temperature, the pressure is increased to about 1200 kg/cm$^2$. The composite is kept under the temperature and pressure for about 2 hours. Then, the temperature and pressure are lowered.

However, when a preform having a hollow inside shown in FIG. 8(*a*) is treated by HIP, abrupt temperature and pressure increase cause uneven deformation of the preform so that a partially excess tensile stress is arisen resulting in rupture of the reinforcing fibers.

Consequently, when a cylindrical composite is fabricated, metal foils 15, shown in FIG. 5, and spiral fibers 14 are lapped each other to make a disk formed preform 16 and the preform is hot-isostatic-pressed.

Such HIP treatment is performed by heating and pressurizing in a capsule type HIP jig 22 as shown in FIG. 6. Pressure from inner side to outer side is not generated so as not to affect the disk formed preform 16 because round shaped metal foils 15 and spiral reinforcing fibers 14 are lapped each other in the arrow direction, resulting in preventing rupture of reinforcing fibers and processing a composite material having even strength.

However, with regard to the disk formed preform 16, it still has the problem that metal foil and spiral-reinforcing fibers are expensive and the form of material processed is restricted. Lapped layers are increased when the thickness of the axial direction is large because the materials are lapped in the axial direction, which brings about high processing cost. Further, since titan is hard to carve, processing cost comes to high even if the material is easily obtained. The fabricating method has such actual drawbacks to use titan as practical parts.

As stated above, the round-formed metal matrix composite has such problems as it is unstable in strength or it is high in fabricating cost owing to the fabricating process.

SUMMARY OF THE INVENTION

In view of the need to solve the prior problems, the present invention has an object to provide a method for fabricating a metal matrix composite having high specific strength, evenly balanced performance as well as capability of fabricating in low cost.

To solve the problems, according to the present invention, a method for fabricating metal matrix composite, wherein a preform of metal matrix with reinforcing fiber is hot-isostatic-pressed by keeping at a high temperature region capable of HIP treatment and of diffusing welding temperature of the metal matrix in a pressure vessel, comprises heating a preform of metal matrix with reinforcing fiber to the temperature, which is below the HIP treatment temperature region, of low temperature region or medium temperature region of the plastic deformation temperature of the metal matrix in a pressure vessel having an initial processing pressure and keeping for a predetermined time for a preparative treatment.

Such preparative treatment prevents abrupt temperature increase in the pressure vessel so as to relax the tensile stress caused by deformation of the preform. Since the inner pressure of the pressure vessel is spontaneously increased while the inner temperature is increased to the HIP treatment temperature, the inner pressure is gradually changed as the inner temperature is gradually changed so that bonding surfaces between the reinforcing fibers and the metal matrix slide, as they are composed. As a result, rupture of reinforcing fibers in the fabrication process of composite material decreases to obtain a composite material having a stable specific strength at a low cost.

Further according to the present invention, in case metal matrix is titan or titan alloy, the preparative treatment is conducted at a preparative treatment temperature of about 300 to 700 degrees Celsius for a sustained time of about 0.5 hours to 2.0 hours.

The invention provides a material having required performance at a low cost using titan or titan alloy as metal matrix when a component part which is light in weight and strong in specific strength such as that of aircraft engine is required.

Preferably, the inner pressure of the pressure vessel is spontaneously increased to about 30 kg/cm$^2$ to 100 kg/cm$^2$ while the inner temperature is increased to the HIP treatment temperature.

Since the above condition is derived from the material characteristics of titan or titan alloy, when the inner pressure of the pressure vessel is below 30 kg/cm$^2$, the metal matrix softens insufficiently. When the inner pressure of the pressure vessel is above 100 kg/cm$^2$, the metal matrix deforms extremely so as to enhance the rupture of reinforcing fibers. Thus, lowering of the strength caused by the fabricating process can be disregarded by setting the pressure as described.

According to another aspect of the invention, the preform is a solid cylinder or a hollow cylinder which is preferably formed by lapping the materials in the radius direction. The hollow cylinder preform may preferably be formed by winding reinforcing fibers around a drum of metal matrix and thermal spraying the metal matrix to the surface of the drum wound with the reinforcing fibers.

Thus applying the method of the present invention to fabrication of a solid cylinder or a hollow cylinder, the materials can be lapped in a radius direction though hitherto the materials are obliged to be lapped in the axial direction. Hence, a composite material having a big dimension in the axial direction can be fabricated in an extremely low cost.

Further according to an embodiment of the present invention, when a preform is fabricated by thermal spraying, malposition of the reinforcing fibers can be controlled to the least extent so as to regularly align the reinforcing fibers, processing a most favorite composite material with regard to its strength.

BRIEF DESCRIPTION OF DRAWINGS

FIG. 8(*b*) is a perspective view showing a conventional roll shape titan matrix composite material.

DETAILED DESCRIPTION OF PREFERRED EMBODIMENTS

The invention will now be described below in detail by way of example with reference to the accompanying drawings. It should be understood, however, that the description herein of specific embodiments such as to the dimensions, the kinds of material, the configurations and the relative disposals of the elemental parts is not intended to limit the invention to the particular forms disclosed but the intention is to disclose for the sake of example unless otherwise specifically described.

Though examples are given as a case of using a matrix of titan alloy and a reinforcing fiber of SiC in this embodiment of the invention, kinds of metal matrix and reinforcing fiber are not restricted so that metal or metal alloy matrix such as aluminum, stainless steel or others and reinforcing fiber such as ceramic fiber or others can be used.

Figure 2:
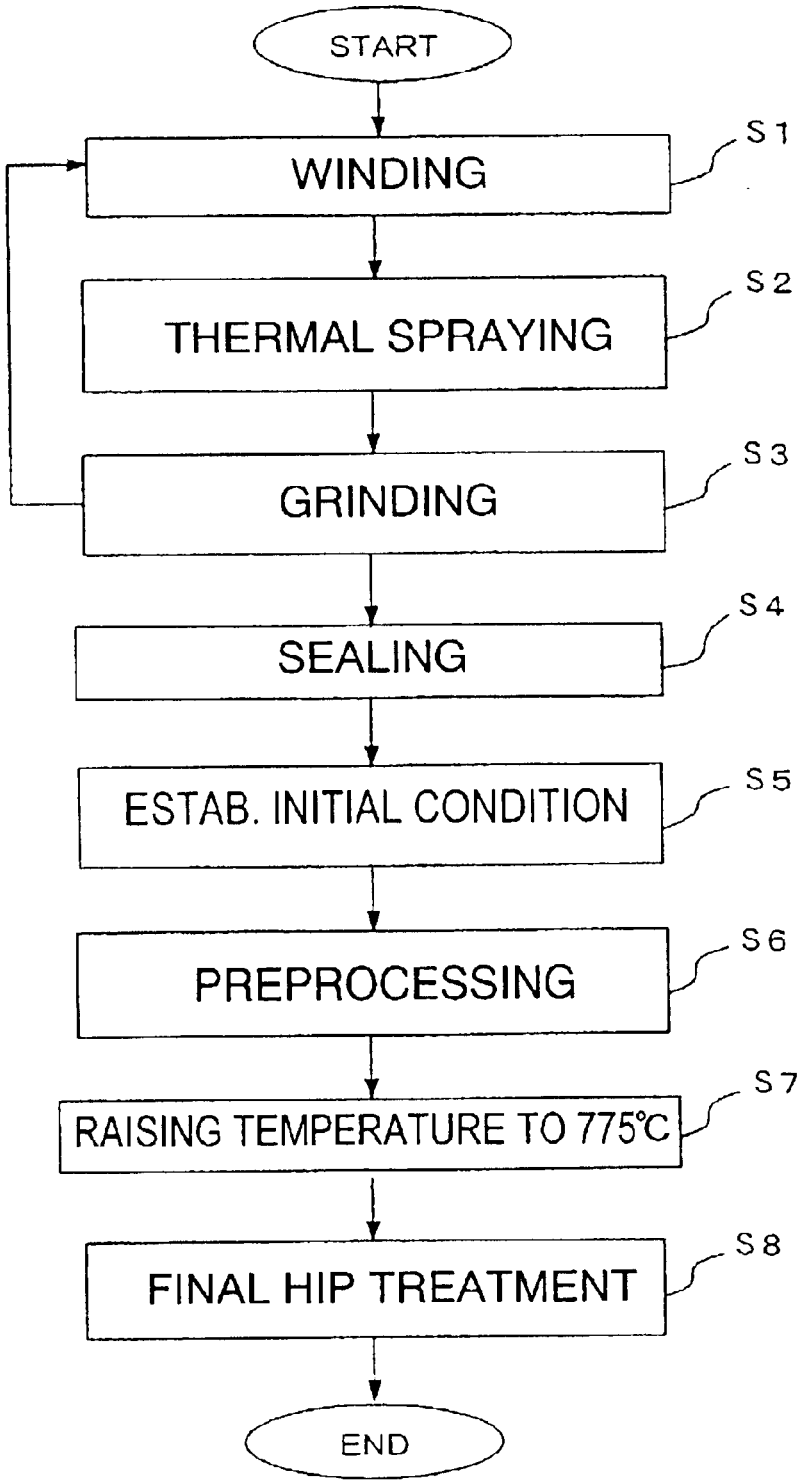
FIG. 2 is a flow chart showing a treating method of composite material according to an embodiment of the present invention.
Figures 3A, 3B, 3C, 3D, 3E, 3F:
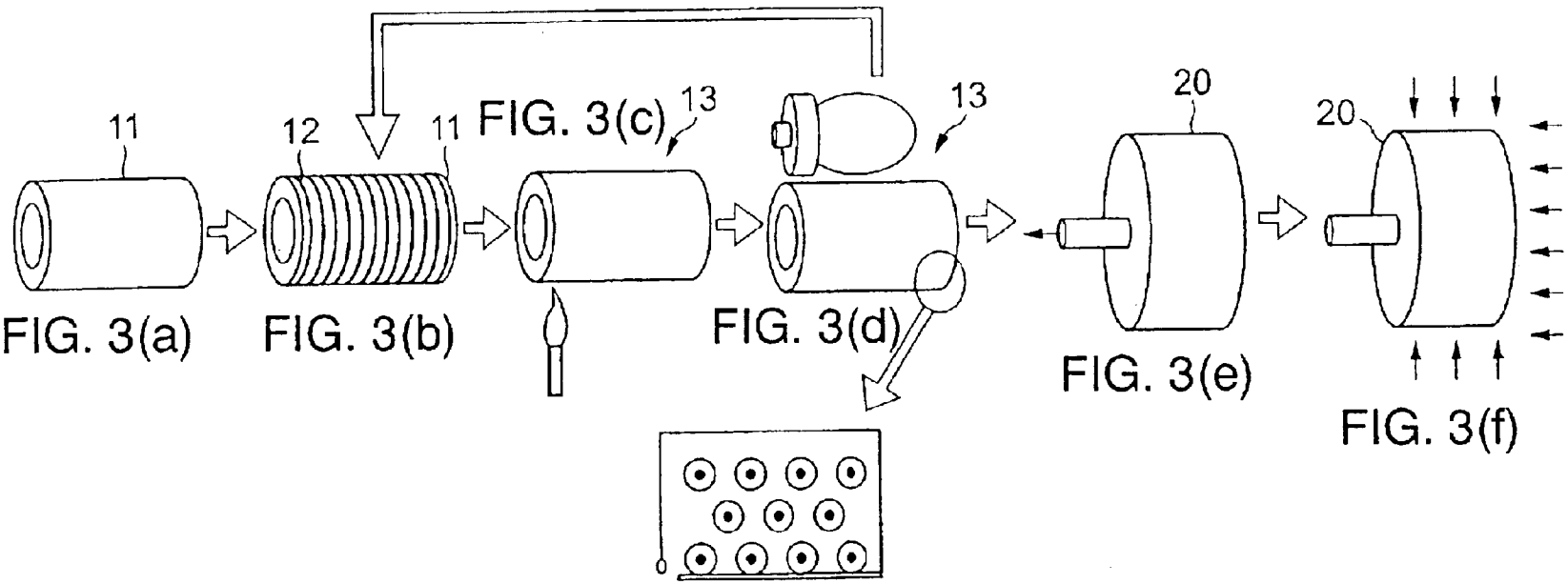
FIGS. 3(*a*)–(*f*) are schematic drawings showing states of treatment at each step of FIG. 2.

A process for fabricating a composite material according to an embodiment of the present invention is explained using FIG. 2 and FIG. 3.

The reinforcing fiber 12 is wound around a titan alloy drum 11 of FIG. 3(*a*) at a constant interstice ((S1), FIG. 3(*b*)). Matrix consisting of titan alloy is thermal sprayed on the surface of the drum 11 wound with the reinforcing fiber 12 ((S2), FIG. 3(*c*)). The thermal sprayed matrix is ground to smooth the surface ((S3), FIG. 3(*d*)).

A series of winding step (S1), thermal spraying step (S2) and grinding step (S3) is repeated predetermined times to produce a ring shape perform 13. The perform is put into the HIP vessel to be sealed in vacuum as shown in FIG. 4 ((S4), FIG. 3(*e*)).

Figure 4:
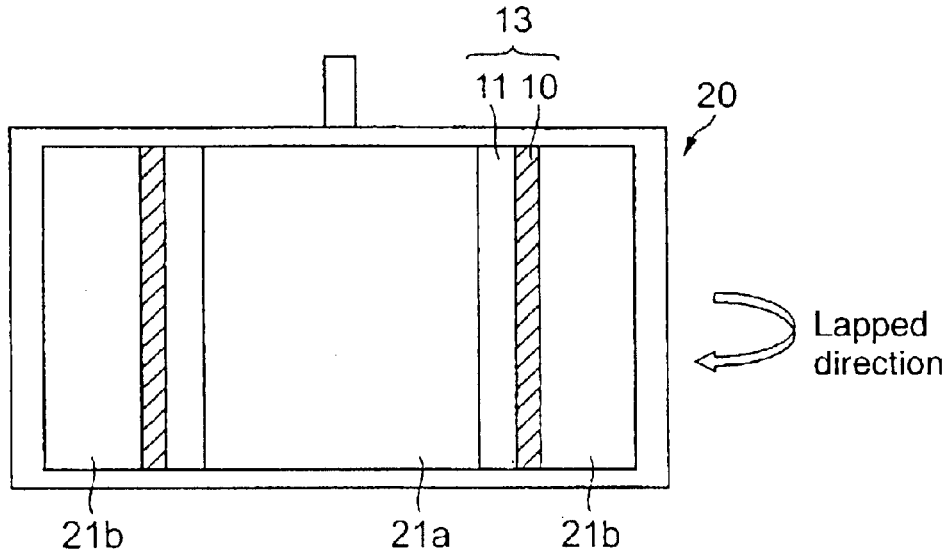
FIG. 4 is a sectional view showing HIP treatment of composite according to an embodiment of the present invention.
Figure 5:
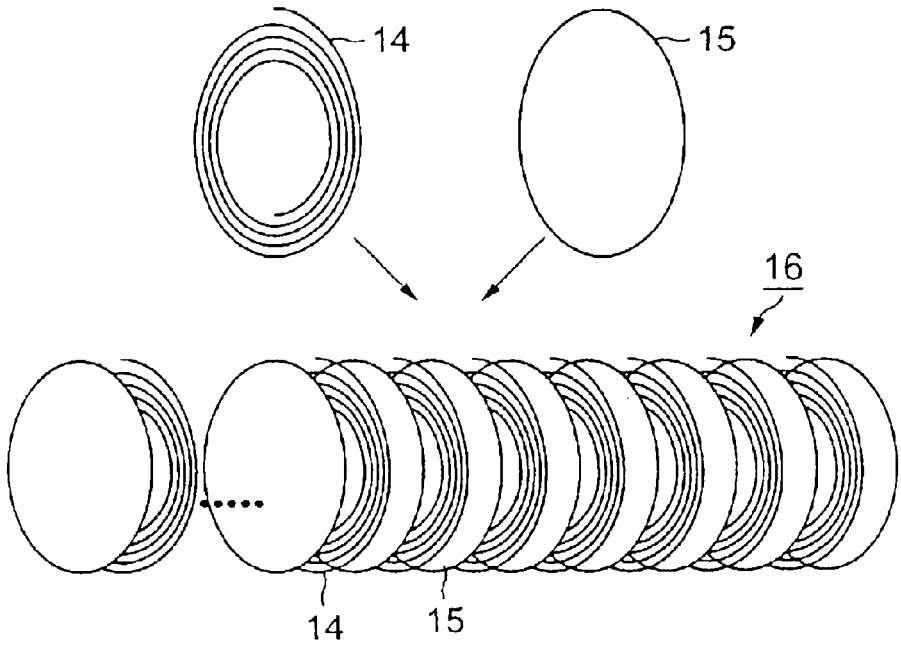
FIG. 5 is a perspective view showing a conventional fabricating process of a disk shape preform.
Figure 6:
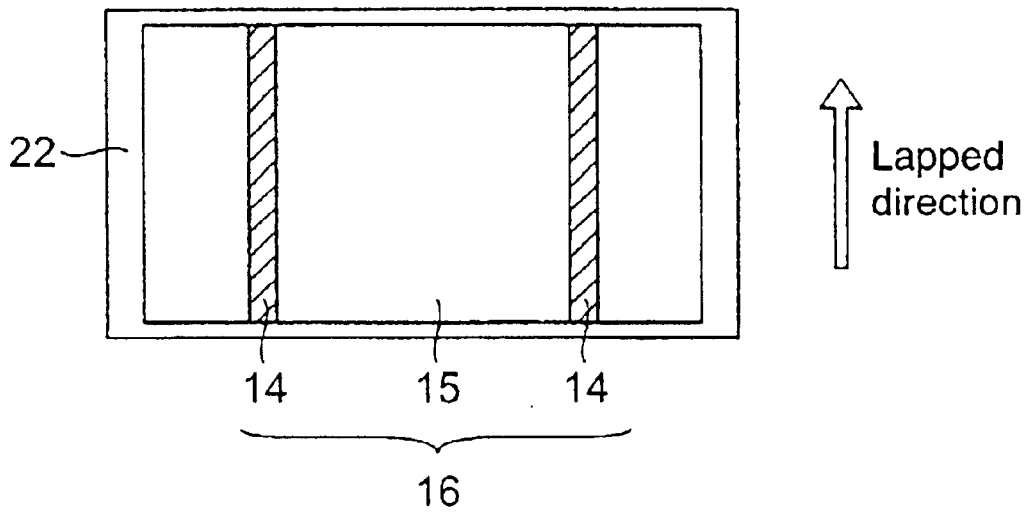
FIG. 6 is a sectional view showing HIP treatment of the composite shown in FIG. 5.
Figure 7:
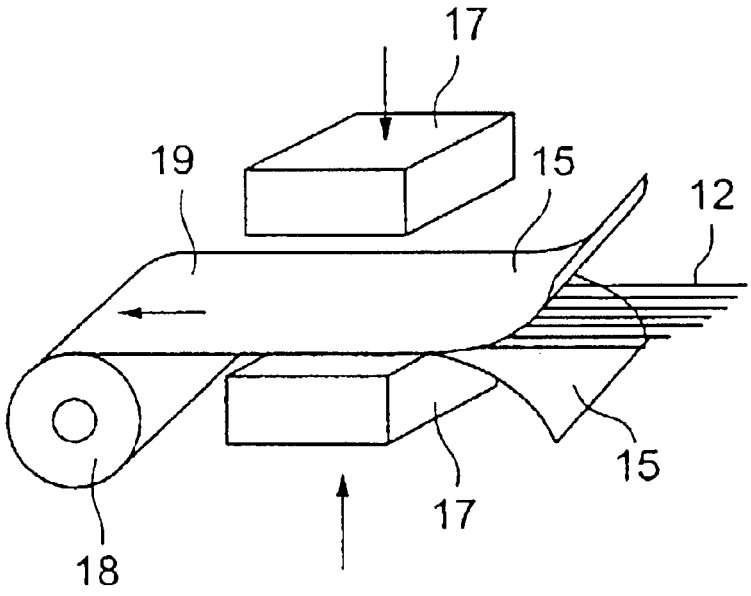
FIG. 7 is a perspective view showing a conventional fabricating process of a mono-tape preform.
Figure 8:
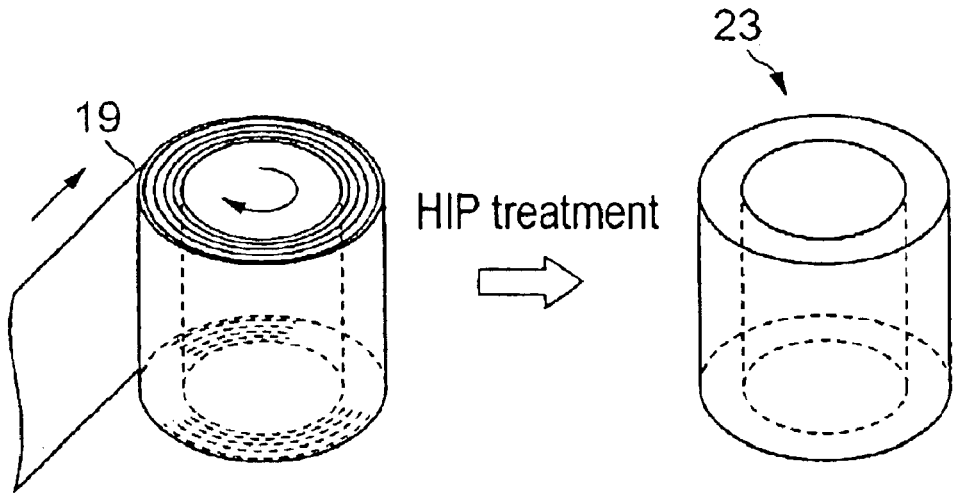
FIG. 8(*a*) is a schematic drawing showing a conventional rolling process of a mono-tape preform.
Figure 9:
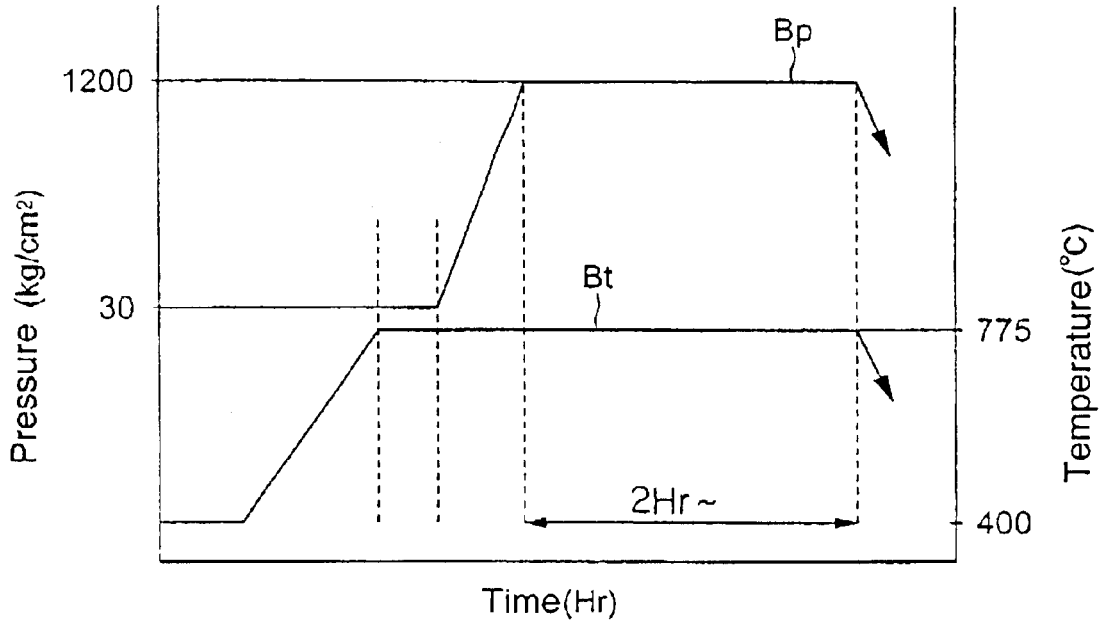
FIG. 9 is a graph showing a relation of temperature and pressure with time in conventional HIP treatment method

In FIG. 4: 20 is a pressure vessel of stainless steel i.e. a HIP jig; 21*a* and 21*b* are mild steel pieces for a positioning device; 21*a* is a HIP inside jig which is inserted in the inner part of the ring; 21*b* is a HIP outside jig which fixes the outer position of the ring; 11 is a titan alloy drum which forms the inside of the ring shape perform; 10 is a preform comprising reinforcing fiber 12 wound around the drum and matrix thermal sprayed thereto; and the preform 10 is lapped in the arrow direction.

According to the embodiment, titan alloy includes (a) Ti-4.5Al-3V-2Mo-2Fe alloy (SP700), (b) pure titan, (c) Ti-6Al-4V alloy, (d) Ti-6Al-6V-2Sn alloy, (e) Ti-6Al-2Sn-2Mo alloy, (f) Ti-15V-3Cr-3Sn-3Al alloy, (g) Ti-5.8Al-4Sn-3.5Zr-0.7Nb-0.5Mo-0.35Si (IML834), (h) Ti-6Al-2.8Sn-4ZR-0.4Mo-0.45Si-0.0702 alloy (Ti-1100), (i) Ti-15Mo-3Nb-3Al-0.2Si alloy (beta21s), (j) Ti-41~52Al-X alloy (titan and aluminum inter metallic compound: X is other additives such as Ti-48Al-2Cr-2Nb), (k) Ti-25Al-10Nb-3V-1Mo alloy (super $\alpha 2$), (l) Ti-14Al-19.5Nb-3V-2Mo alloy ($Ti_3Al$ inter metallic compound), (m) Ti-24Al-11Nb alloy ($Ti_2AlNb$).

Meanwhile, HIP treatment is applied to the ring shape perform 13 enclosed in the HIP jig 20 at the temperature and pressure shown in FIG. 1 to be hereinafter described (f).

First, in the HIP jig 20 an initial pressure of about 30 kg/cm$^2$ and temperature of about 400° C. is established (S5)

and then temperature is raised to a preprocessing temperature of about 500° C. ~700° C., preferably to about 600° C. to process for 1 hour (S6). After that, the temperature is gradually raised to about a HIP treatment temperature of 775° C. for about an hour (S7). While the temperature is kept constant, the inner pressure of the jig is increased to a HIP treatment pressure of about 1200 kg/cm$^2$ and kept for about 2 hours (S8).

Figure 1:
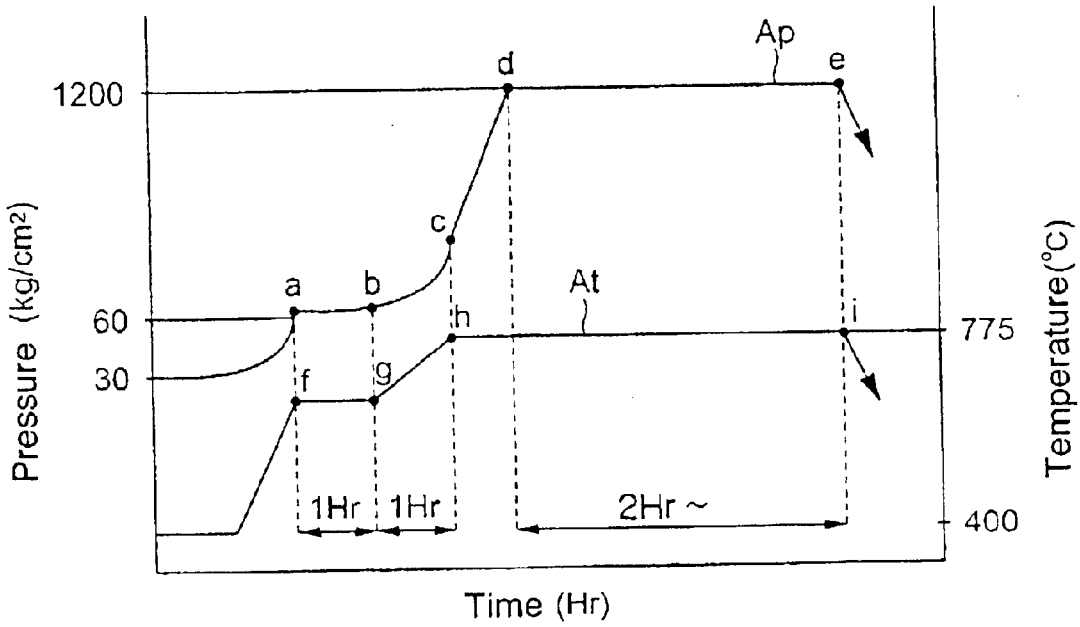
FIG. 1 is a graph showing a relation of temperature and pressure with time in HIP treatment method according to an embodiment of the present invention.

FIG. 1 is a graph showing a temperature and pressure condition of the aforementioned HIP treatment. In FIG. 1, Ap denotes a pressure condition and At a temperature condition of the HIP treatment according to the present embodiment. The pressure between point a and b or f and g is that of preprocessing step.

In such example of HIP treatment, when temperature is raised from an initial stage to a preprocessing temperature of 600° C., the inner pressure of the jig is spontaneously raised to point a. Further, the preprocessing is performed for about 1 hour where the preform is kept under the condition of a pressure of about 30 kg/cm$^2$ to 100 kg/cm$^2$, preferably about 60 kg/cm$^2$ and of a temperature of 500° C. to 700° C., preferably about 600° C.

After the preprocessing, temperature is gradually raised to a HIP temperature of about 775° C. of h point during an extended time of about one hour while pressure is increased spontaneously between point b and c. When the pressure reaches point c, the pressure is increased to a HIP pressure of 1200 kg/cm$^2$ and kept for about 2 hours at d point. After that, the pressure and the temperature are lowered.

Thus, according to the present invention, the tensile stress caused by deformation of the preform is relaxed by preprocessing and by spontaneously increasing the pressure before and after the preprocessing to gradually transfer the condition of pressure and temperature. As a result, rupture of reinforcing fibers in the fabrication process of composite material decreases to obtain a composite material having a stable specific strength at a low cost.

Though a preform produced by winding reinforcing fiber to a titan alloy drum and thermal spraying matrix thereon is used in this embodiment, a preform produced by convolving mono-tape preform, a disk shape preform and preforms having any other shapes can be applied.

What is claimed is:

1. A method for fabricating metal matrix composite, wherein a preform of metal matrix with reinforcing fiber is hot-isostatic-pressed by keeping at a high temperature region capable of HIP treatment and of diffusing welding temperature of the metal matrix in a pressure vessel, comprising heating a preform of metal matrix with reinforcing fiber to the temperature, which is below the high temperature region, of low temperature region or medium temperature region of the plastic deformation temperature of the metal matrix in a pressure vessel having an initial processing pressure and keeping for a predetermined time for a preparative treatment.

2. A method for fabricating metal matrix composite according to claim 1 wherein the inner pressure of the pressure vessel is spontaneously increased while the inner temperature is increased to the HIP treatment temperature.

3. A method for fabricating metal matrix composite according to claim 1 wherein, in case metal matrix is titan or titan alloy, the preparative treatment is conducted at a preparative treatment temperature of about 300° C. to 700° C. for a sustained time of about 0.5 hours to 2.0 hours.

4. A method for fabricating metal matrix composite according to claim 3 wherein the inner pressure of the pressure vessel is spontaneously increased to about 30 kg/cm$^2$ to 100 kg/cm$^2$ while the inner temperature is increased to the HIP treatment temperature.

5. A method for fabricating metal matrix composite according to claim 3 wherein the preform is a solid cylinder or a hollow cylinder which is formed by lapping the materials in the radius direction.

6. A method for fabricating metal matrix composite according to claim 5 wherein the hollow cylinder preform is formed by winding reinforcing fibers around a drum of metal matrix and thermal-spraying the metal matrix to the surface of the drum wound with the reinforcing fibers.

* * * * *